US006520818B1

(12) United States Patent
Wakamatsu et al.

(10) Patent No.: US 6,520,818 B1
(45) Date of Patent: Feb. 18, 2003

(54) METHOD FOR MANUFACTURING CATHODE RAY TUBE AND MANUFACTURING APPARATUS

(75) Inventors: Yasuo Wakamatsu, Matsudo (JP); Kazumasa Hirayama, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/422,079

(22) Filed: Oct. 21, 1999

(30) Foreign Application Priority Data

Oct. 26, 1998 (JP) ..... 10-304240
Sep. 29, 1999 (JP) ..... 11-276822

(51) Int. Cl.[7] ..... H01J 9/20; H01J 9/22; H01J 9/42

(52) U.S. Cl. ..... 445/3; 445/63; 430/24; 430/26

(58) Field of Search ..... 445/3, 63; 430/26, 430/24

(56) References Cited

U.S. PATENT DOCUMENTS 4,377,890 A * 3/1983 Miller ..... 29/430
4,850,921 A * 7/1989 Hama et al. ..... 445/63
4,871,415 A * 10/1989 Park et al. ..... 156/345
4,989,072 A * 1/1991 Sato et al. ..... 324/404
5,019,004 A * 5/1991 Steiner et al. ..... 220/2.1 A
5,059,147 A * 10/1991 Adler et al. ..... 445/4
5,145,432 A * 9/1992 Midland et al. ..... 445/3
5,343,803 A * 9/1994 Duchek et al. ..... 101/35
5,725,977 A * 3/1998 Hojo et al. ..... 430/24
5,762,528 A * 6/1998 Ninomiya ..... 445/3
5,873,759 A * 2/1999 Ball et al. ..... 445/3
6,085,183 A * 7/2000 Horn et al. ..... 706/45

FOREIGN PATENT DOCUMENTS

JP 3-159028 7/1991
JP 4-242043 8/1992
JP 06139939 * 5/1994 ..... H01J/9/42

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

The present invention provides a method of manufacturing a cathode ray tube, comprising a step of automatically setting peculiar information to a panel of a cathode ray tube, a step of performing a plurality of treatments on an inner surface of the panel of the cathode ray tube, thereby forming a phosphor film pattern on the inner surface, a step of automatically measuring a condition set in the phosphor film pattern forming step, a step of automatically storing a measurement value obtained in the measuring step such that the value is coupled with the peculiar information, a step of inspecting the panel obtained in the treatment step to determine whether or not the panel is defective, and a step of automatically storing a defectiveness code coupling with the peculiar information if the panel is determined to be defective.

17 Claims, 5 Drawing Sheets

FIG. 7
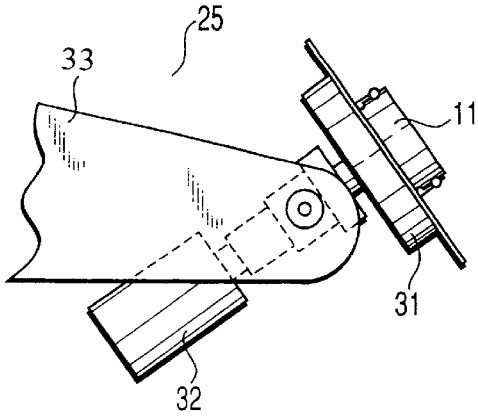
FIG. 8
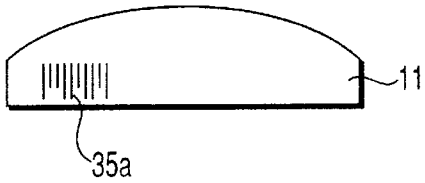
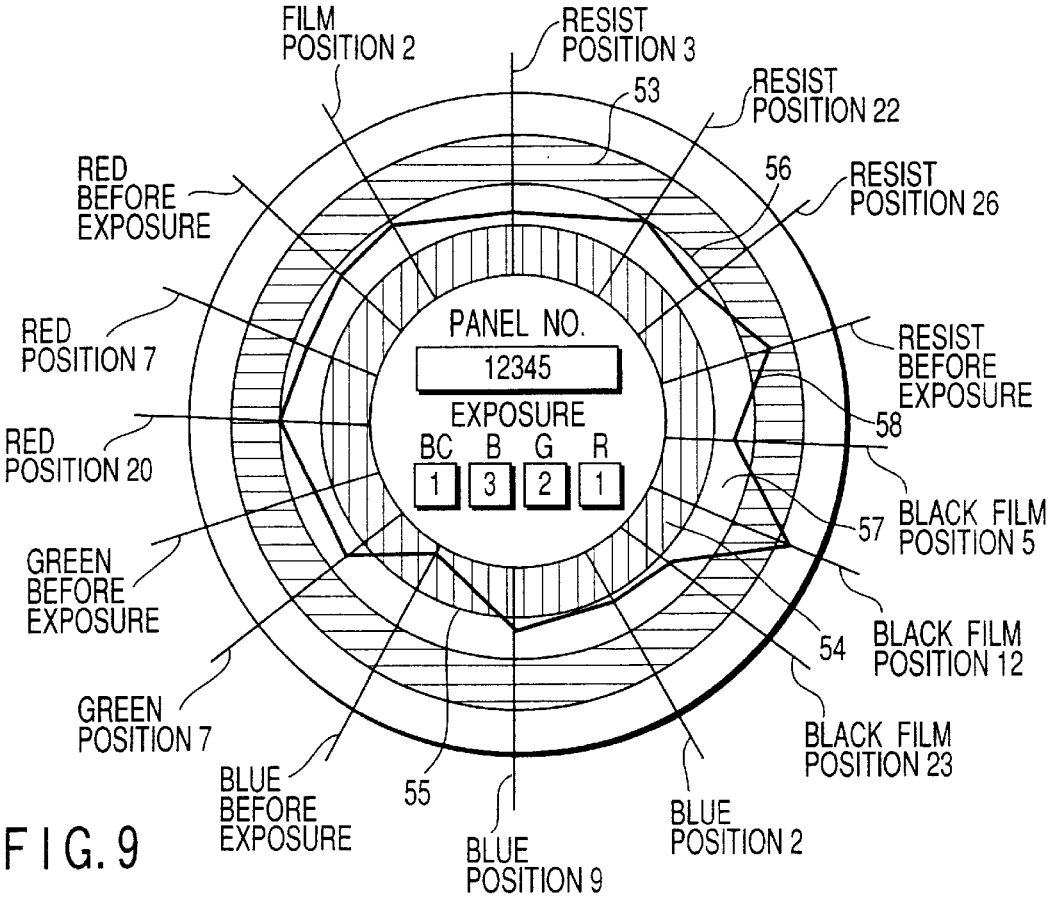
FIG. 9

METHOD FOR MANUFACTURING CATHODE RAY TUBE AND MANUFACTURING APPARATUS

BACKGROUND OF THE INVENTION

This invention relates to a cathode ray tube manufacturing method for subjecting a component part of a cathode ray tube to a predetermined treatment, and also to a manufacturing apparatus.

In general, in a process for forming a phosphor film of a desired pattern on the inner surface of a panel as a component part of a cathode ray tube, first, a black film 12 of a predetermined pattern is formed on the inner surface of a curved glass substrate which constitutes a panel 11, as is shown in FIGS. 1 and 2. The pattern of the black film 12 is, for example, a regular arrangement of a large number of circular holes 13 as shown in FIG. 3.

The black film 12 is formed by to a resist coating step, an exposure step performed using a shadow mask, a developing step performed without the shadow mask, and a step for coating a black conductive substance called a "dag", on the inner surface of the panel 11.

After that, phosphor films 14 of blue, green and red are provided in the holes of the black film 12 as shown in FIG. 4. Also in this case, a phosphor screen consisting of the phosphor films 14 of the three colors and having a desired pattern is formed by the coating step for coating phosphors of three colors, a step for combining the panel 11 with a shadow mask, an exposure step performed through the shadow mask, and a developing step performed without the shadow mask. The phosphor screen is finished after a filming step or an aluminum forming step in which an aluminum film 15 is provided by sputtering.

In the above-mentioned phosphor screen forming process, however, it is possible that various types of defects will occur. For example, unless the panel temperature is kept at a desired value before exposure, the light radiation position may change due to thermal expansion of the panel at the time of exposure, thereby changing the landing position of each electron beam on the phosphor films. As a result, quality degradation may occur wherein sufficient white uniformity (WU), which should be obtained when blue, green and red are simultaneously lit, cannot be obtained.

Further, in the developing step, the phosphor films are developed by spraying a developer from a nozzle on the phosphor films. If the spraying pressure of the developer is very high, part of the phosphor will be removed to excess. This may reduce the thickness of the phosphor film to thereby degrade its brightness, or may peel off necessary part of the phosphor.

On the other hand, if the spraying pressure of the developer is very low, a defect, so-called a mixture of colors, will occur in which a desired color is mixed with another color. Moreover, if the spraying pressure of the developer varies with time or position of the phosphor film, the developer cannot be applied uniformly.

As described above, both the spraying pressure and temperature of the developer are important factors which will influence the development, and the viscosity, density and temperature of phosphor are regarded as important factors for forming a phosphor film. Accordingly, in order to form a phosphor film of a high quality, it is important to set, constant, manufacturing conditions such as the panel temperature assumed when coating the panel with phosphor, the viscosity, density and temperature of phosphor, the temperature and spraying pressure of the developer, the panel temperature assumed at the time of exposure, the temperature, humidity and purity of the atmosphere in the manufacturing room, etc.

The quality of the manufactured phosphor surface is usually inspected at the outlet of the phosphor film forming apparatus. This inspection is performed manually, with to-be-inspected panels placed on a panel conveyor or on an illuminated table onto which the panels are transferred from the conveyor. However, by manual inspection, it is very difficult to determine the cause of a defect in the film when it is found. Since there are so many factors that can be considered the cause of the defect, it is very difficult even for skilled engineers or workers to determine it.

BRIEF SUMMARY OF THE INVENTION

It is an object of the present invention to provide a method for manufacturing a cathode ray tube, which can easily detect the cause of a defect, if it is found in a structural element of the tube.

It is another object of the present invention to provide an apparatus for manufacturing a cathode ray tube, which can easily detect the cause of a defect, if it is found in a structural element of the tube.

According to an aspect of the invention, there is provided a method of manufacturing a cathode ray tube, comprising the steps of: automatically setting peculiar information to a structural element of a cathode ray tube; performing one or more treatments on the structural element of the cathode ray tube; automatically measuring a treatment condition in the treatment step; automatically storing a measurement value obtained in the measuring step to couple the value with the peculiar information; and inspecting the structural element obtained in the treatment step to determine whether or not the structural element is defective.

According to another aspect of the invention, there is provided a method of manufacturing a cathode ray tube, comprising the steps of: automatically setting peculiar information to a panel of a cathode ray tube; performing a plurality of treatments on an inner surface of the panel of the cathode ray tube, thereby forming a phosphor film pattern on the inner surface; automatically measuring a treatment condition in the phosphor film pattern forming step; automatically storing a measurement value obtained in the measuring step to couple the value with the peculiar information; inspecting the panel obtained in the treatment step to determine whether or not the panel is defective; and automatically storing a defectiveness code to couple with the peculiar information if the panel is determined to be defective.

According to a further aspect of the invention, there is provided an apparatus for manufacturing a cathode ray tube, comprising: means for automatically setting peculiar information to a structural element of a cathode ray tube; means for performing one or more treatments on the structural element of the cathode ray tube; means for automatically measuring a condition of the treatment performed by the treatment means; a controller for automatically storing a measurement value obtained by the measurement means to couple the value with the peculiar information; and means for inspecting the structural element treated by the treatment means to determine whether or not the structural element is defective.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 7 is a view showing part of a coating unit used in the process of manufacturing a cathode ray tube, according to one embodiment of the invention;

FIG. 8 is a side view of a panel of a cathode ray tube, having panel information printed thereon;

FIG. 9 is a radar chart illustrating an example of data items collected in the process of manufacturing a cathode ray tube, according to one embodiment of the invention.

DETAILED DESCRIPTION OF THE INVENTION

The present invention is characterized in that information peculiar to each structural element is set and input, and in that the information set for each structural element and a measurement value obtained when each structural element is subjected to a predetermined treatment are stored such that the information and the measurement value are coupled with each other.

The cathode ray tube manufacturing method and apparatus according to the present invention, constructed as above, can easily detect the cause of a defective structural element, when it is found by the inspection performed after the treatment.

Further, the cause of a defective structural element, when it is found during the inspection performed after the treatment, can be easily detected by storing information concerning an equipment for performing a predetermined treatment on structural elements of cathode ray tubes, and peculiar information set for each structural element, such that both the information items are coupled with each other.

Also, the cause of a defective structural element, when it is found during the inspection performed after the treatment, can be easily detected by measuring a characteristic of each component part used for performing a predetermined treatment on structural elements of cathode ray tubes, and then storing it coupling with peculiar information set for each structural element.

Yet further, the cause of a defective structural element, when it is found during the inspection performed after the treatment, can be easily detected by measuring a characteristic of each semifinished product obtained in the middle of a process for performing a predetermined treatment on structural elements of cathode ray tubes, and then storing it coupling with peculiar information set for each structural element.

The cause of a defective structural element, when it is found during the inspection performed after the treatment, can be easily detected by inputting a defectiveness code indicating the defective structural element, and storing the code coupling with peculiar information set for each structural element.

In addition, the use of a relational data base (typical data base structure which is used in information system of enterprises) as means for storing the above information items coupling with each other enables retrieval based on complex prerequisites and hence extraction of information in an optional condition.

Referring now to the accompanying drawings, an apparatus for manufacturing a cathode ray tube, according to one embodiment of the present invention, will be described.

Figure 1:
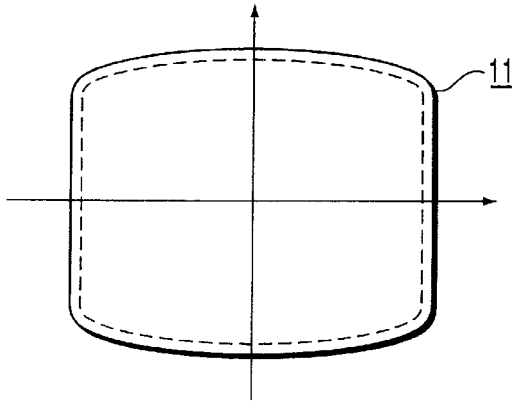
FIG. 1 PRIOR ART
FIG. 1 is a plan view illustrating a conventional cathode ray tube panel.
Figure 2:
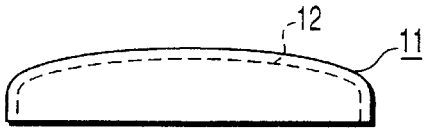
FIG. 2 PRIOR ART
FIG. 2 is a front view illustrating a conventional cathode ray tube panel.
Figure 3:
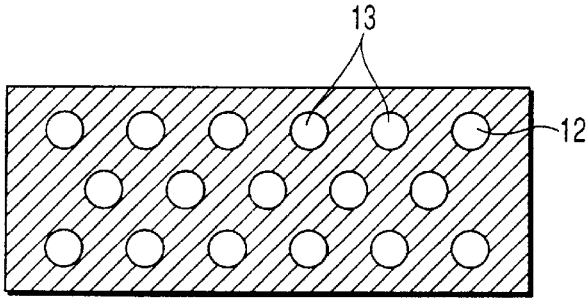
FIG. 3 PRIOR ART
FIG. 3 is a view illustrating a black film provided on the inner surface of a conventional cathode ray tube panel.
Figure 4:
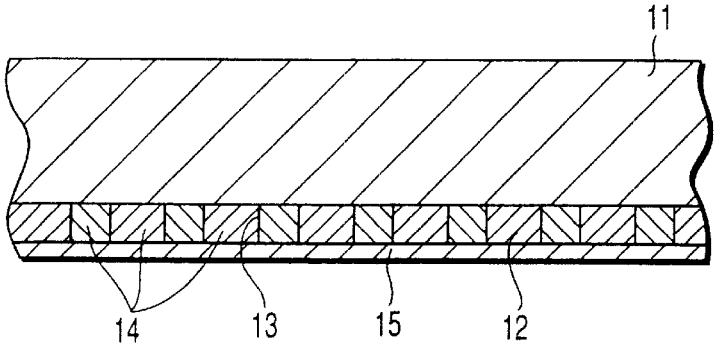
FIG. 4 PRIOR ART
FIG. 4 is an enlarged sectional view showing a phosphor surface provided on the inner surface of a cathode ray tube panel.
Figure 5:
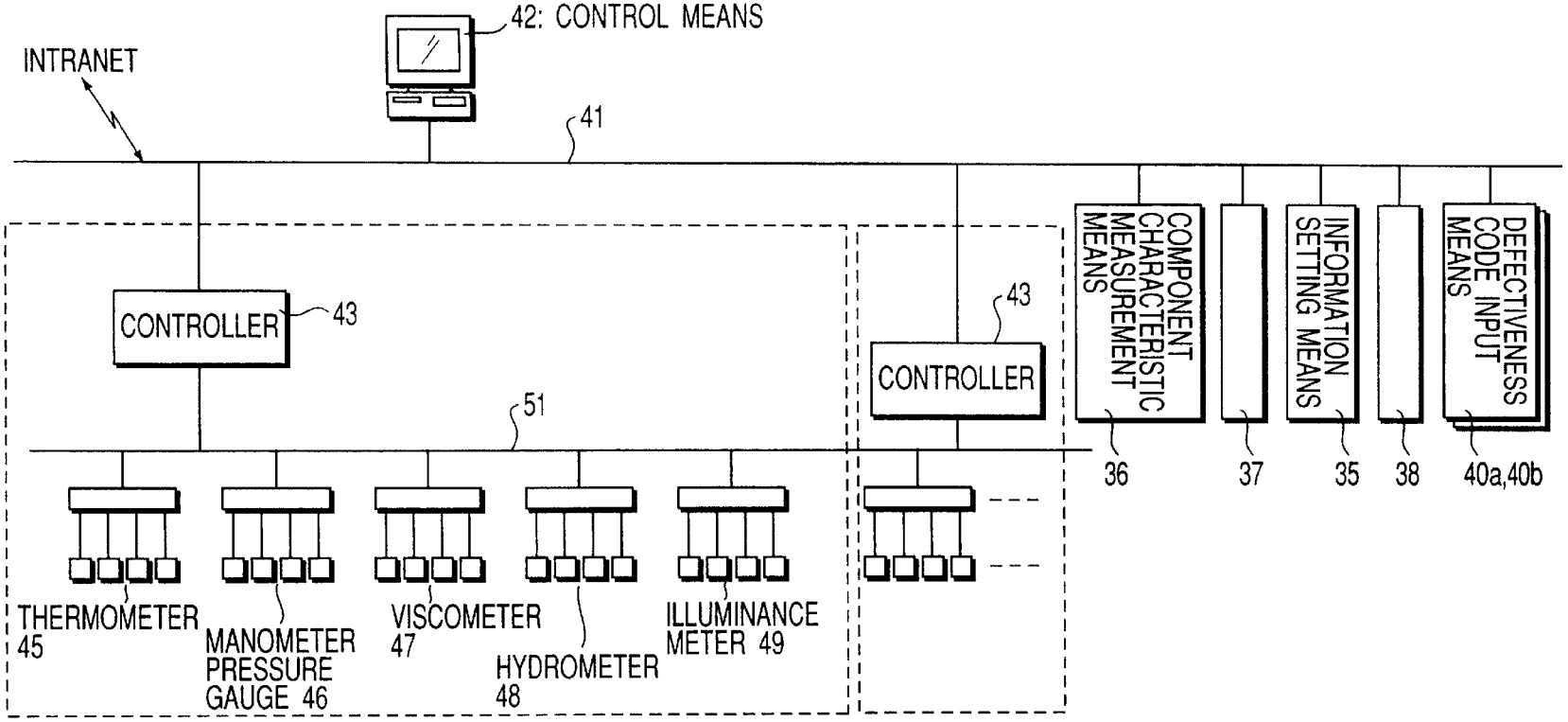
FIG. 5 is a block diagram illustrating an apparatus for manufacturing a cathode ray tube, according to one embodiment of the present invention.
Figure 6:
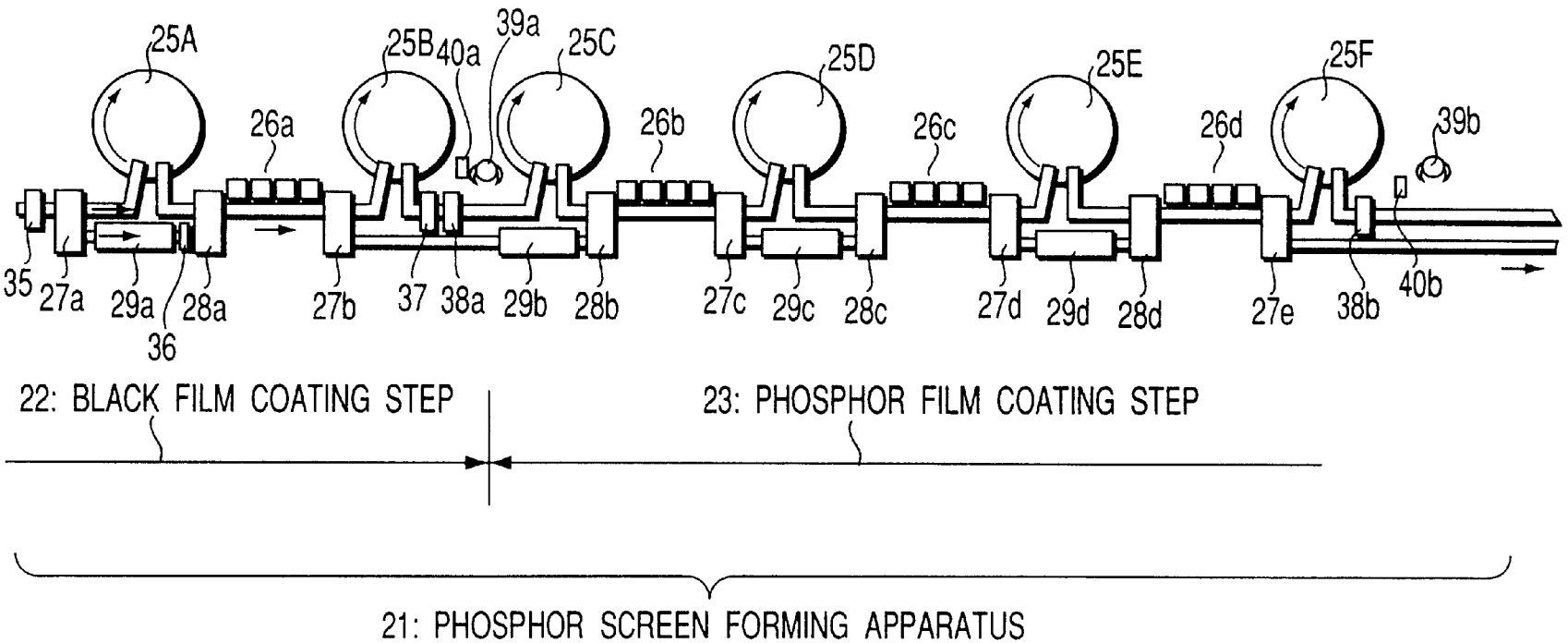
FIG. 6 is a view useful in explaining the process of manufacturing a cathode ray tube, according to one embodiment of the invention.

FIG. 5 is a block diagram showing the apparatus for manufacturing a cathode ray tube, according to one embodiment of the present invention. FIG. 6 is a view useful in explaining the structure of the apparatus.

In FIG. 6, reference numeral 21 denotes the entire phosphor surface forming apparatus. The former stage of the phosphor surface forming process performed by the phosphor surface forming apparatus 21 corresponds to a black film coating process section 22, and the latter stage corresponds to a phosphor film coating process section 23.

The phosphor surface forming apparatus 21 comprises a plurality of coating units 25A–25F, and a plurality of exposure units 26*a*–26*d* each interposed between a corresponding pair of adjacent ones of the coating units, i.e. between the coating units 25A and 25B, between the coating units 25C and 25D, and between the coating units 25D and 25E, and between the coating units 25E and 25F.

Separating units 27*a*14 27*e* for separating a shadow mask (not shown) from a panel 11 are provided before the coating units 25A, 25B, 25D, 25E and 25F, respectively. Further, combining units 28*a*–28*d* for recombining the separated panel 11 and shadow mask are provided after the coating units 25A, 25C, 25D and 25E, respectively. The shadow mask separated by the separating units 27*a*–27*d* is transferred to the combining units 28*a*–28*d* by transfer units 29*a*–29*d*, respectively.

The coating units 25A–25F specifically consist of a resist coating unit 25A, a dag coating unit 25B, a blue phosphor coating unit 25C, a green phosphor coating unit 25D, a red phosphor coating unit 25E, and a finishing unit 25F for a final finishing process such as a filming process, respectively.

The coating units 25A–25F each have a carrier head 31 as shown in FIG. 7 for holding the panel 11 from which a shadow mask is removed. The carrier head 31 is attached to an end portion of an arm 33 together with a spin motor 32, and adapted to be driven by the spin motor 32. The panel 11 held by the carrier head 31 is intermittently transferred by the arm 33 along a circular path so that it will stop at each treatment unit such as a cleaning unit (not shown), each coating unit, a drying unit (not shown), etc.

A plurality of exposure units 26*a*–26*d* are provided between each pair of adjacent ones of the coating units for exposing the inner surface of the panel 11, to which a resist, dag (black conductive material) and phosphor are applied by the coating units, and a shadow mask is attached by the combining units 28*a*–28*d*. The reason why a plurality of exposure units are provided in each position is to secure a predetermined exposure time. The number of the exposure units corresponds to the required exposure time.

Before subjecting a component part, e.g. the panel 11, of the cathode ray tube to a predetermined process for forming a phosphor surface thereon, panel information peculiar to each to-be-processed panel 11 is set and stored, and after the process, the panel information is coupled with to information concerning the actual process performed on each panel 11. This enables prompt and easy detection of the cause of a defect, if it is found in each panel 11 after the process.

Information concerning the process includes process conditions under which each panel 11 must be processed, information on a unit for performing a predetermined process on each panel 11, for example, the exposure unit 26 for the exposure process, a characteristic of a component part used for the predetermined process on each panel 11, for example, the transmittance of a shadow mask, a characteristic of a semifinished product obtained in the middle of the process for each panel 11, for example, the size of a black film, or a defectiveness code input to indicate a defective product detected after inspection.

To set and store such information, the apparatus shown in FIG. 6 has the following means. A printing unit 35 as means for setting panel information peculiar to each panel 11 is installed at the inlet of the phosphor surface forming apparatus 21. The panel information preferably indicates the type, serial number, date of manufacture, etc. of each cathode ray tube, and a bar code 35*a*, for example, is printed on a side surface of each panel 11.

Further, mask transmittance measurement means 36 is provided, downstream of the transfer unit 29*a*, as component characteristic measurement means for measuring the transmittance of a shadow mask as a component part. Black film size measurement means 37 is provided, downstream of the dag (black conductive material) coating unit 25B, as semifinished product measurement means for measuring the size of the black film of each panel 11 as a semifinished product.

Moreover, readers 38*a* and 38*b* for reading panel information are provided at the outlets of the black film coating process section 22 and the phosphor film coating process section 23, respectively. Similarly, terminal units 40*a* and 40*b* are provided at the outlets of the black film coating process section 22 and the phosphor film coating process section 23, respectively, for inputting a defectiveness code indicating a defective product when inspectors 39a and 39b have found a defective panel 11.

The printing unit 35, the mask transmittance measurement means 36, the black film size measurement means 37, the readers 38*a* and 38*b*, the terminal units 40*a* and 40*b* are connected, via a factory basic LAN 41, to a control unit 42 as control means for controlling the entire apparatus, as is shown in FIG. 5. Equipment information used for performing the predetermined process on each panel 11, for example, the numbers of the exposure units 26*a*–26*d*, can be registered in the control unit 42.

There are also provided controllers 43*a*, 43*b*, . . . for controlling respective processes performed in the resist coating unit 25A, the dag coating unit 25B, each color phosphor coating unit 25C, 25D, 25E, and the finishing unit 25F. The controllers 43*a*, 43*b*, . . . are also connected to the control unit 42 via the factory basic LAN 41.

As described above, process conditions necessary for performing the predetermined process on each panel 11 can be obtained. To obtain them, there are provided, for respective processes, a necessary number of thermometers 45, pressure gauges 46, viscometers 47, hydrometers 48 and illuminance meters 49. The measurement values obtained from these meters are input as necessary process conditions to the controllers 43 via a distributed network 51, and further input to the control unit 42 via the basic LAN 41.

The necessary process conditions include, for example, the temperature of each panel 11 to be loaded into or unloaded from the coating units 25A–25F, the spraying pressure of the developer, the temperature, density and viscosity of phosphor, the temperature of each panel 11 before exposure, the brightness of the light sources of the exposure units 26*a*–26*d*, or the temperature and humidity of the atmosphere around the manufacturing apparatus.

The thermometers 45, pressure gauges 46, viscometers 47, hydrometers 48 and illuminance meters 49 measure the process condition values. The measurement values are finally input to the control unit 42, which in turn processes the measurement data and displays the resultant data.

The operation of the above-described apparatus will now be described.

When a panel 11 with a shadow mask attached to face its inner surface has been transferred from the previous process section (not shown) into the inlet of the black film coating process section 22 of the phosphor surface forming apparatus 21 shown in FIG. 6, panel information peculiar to the panel 11 is printed and set on a side surface of the panel by the printing unit 35. The panel information indicating the loaded panel is input to the control unit 42 via the basic LAN 41.

After the shadow mask is separated from the panel 22 by the separating unit 27*a*, the panel 11 is loaded into the resist coating unit 25A. The panel 11 loaded therein is held by the carrier head 31 shown in FIG. 7 and intermittently transferred along a circular path while it is spun, whereby it is subjected to predetermined treatments in the cleaning, resist coating and drying processes. At this time, the measurement values obtained from the various meters shown in FIG. 5 are input as necessary process conditions to the control unit 42.

After that, the panel 11 is unloaded from the resist coating unit 25A, then combined with the shadow mask by the combining unit 28*a*, and loaded into the exposure unit 26*a* where it is subjected to exposure.

After the exposure, the shadow mask is again separated from the panel 11 by the separating unit 27*b*, and loaded into the dag coating unit 25B. The panel is coated with "dag" as the material of the black film 12, whereby the black film 12 is formed on the inner surface of the panel 11 through a predetermined treatment. Thus, a panel with a black film, a semifinished product, is obtained.

At the outlet of the black film coating process section 22, the black film size measurement means 37 measures the size of the black film 12, while the reader 38*a* reads panel information of each panel 11 and inputs it to the control unit 42.

Further, the inspector 39*a* inspects whether the black film 12 is formed to a desired quality. If a defect is found in the film, the inspector 39*a* inputs a defectiveness code to the control unit 42, using the terminal unit 40*a* (defectiveness code input means).

In the black film coating process section 22, the mask transmittance measurement means 36 measures the transmittance of the shadow mask separated from the panel 11 by the separating unit 27, and inputs it to the control unit 42.

The panel 11 is then transferred to the phosphor film coating process section 23, where it is coated with blue phosphor by the phosphor coating unit 25C for applying blue phosphor, then combined with the shadow mask by the combining unit 28, exposed by the exposure unit 26*b*, and again separated from the shadow mask by the separating unit 27*c*.

Similarly, the phosphor coating unit 25D applies green phosphor to the panel, and the phosphor coating unit 25E applies red phosphor to the panel. Finally, the finishing unit 25F performs a finishing treatment such as a filming treatment on the panel.

Also at the outlet of the phosphor film coating process section 23, the reader 38*b* reads panel information of the panel 11, and the inspector 39*b* inspects whether or not the phosphor film is formed to a desired quality. If a defect is found in the film, the inspector 39*b* inputs a defectiveness code to the control unit 42, using the terminal unit 40*b* (defectiveness code input means).

Thus, a phosphor surface is formed on the panel 11. The process conditions obtained in each process, i.e. the measurement values such as the temperature of the panel 11, the temperature or pressure of the developer, the temperature, density or viscosity of phosphor, the integrated light amount of the light sources of the exposure units 26, etc., are input to the control unit 42. The control unit 42 stores these values such that they correspond to the already input panel information.

Each time the panel 11 passes through each of the coating units 25A–25E and the finishing unit 25F, the control unit 42 shifts panel information items from one to another, and stores each measurement value input in each process, the number of the exposure unit 26*a*–26*d* used in each process, a characteristic such as the transmittance of the shadow mask, the size of the black film, input defectiveness code, etc. such that these values are coupled with the present panel information.

The thus-obtained data is processed, for example, as shown in FIG. 9. FIG. 9 is a radar chart showing measured temperatures of a certain panel 11 (panel No. 12345). Since in the chart, the temperature of each panel 11 collected in each position in each process performed by the phosphor surface forming apparatus 21 is indicated, the manufacturing history of each panel 11 and hence a problem, if any, can be understood easily.

In the FIG. 9 case, concerning the temperature of the panel, an upper limit warning area 53 (an outer hatched annular area), a lower limit warning area 54 (an inner hatched annular area), a lower limit line 55, an upper limit line 56, an appropriate area 57 (an annular area between the lower limit line 55 and the upper limit line 56) are set. Further, from FIG. 9, the relationship between the set areas and the actual temperature indicated by line 58 can be understood. With reference to the relationship, an alarm signal can be output.

Also, an abnormality in the entire process, if any, can be grasped promptly, which enables a prompt feedback operation for the process. Furthermore, analysis of a defectiveness code input by the inspector 39*a* or 39*b* enables detection of a tendency peculiar to the defectiveness and hence enables accurate measures for dealing with the defectiveness. Also, the inspection result of each inspector can be obtained by inputting the inspectors' names.

Figure 10:
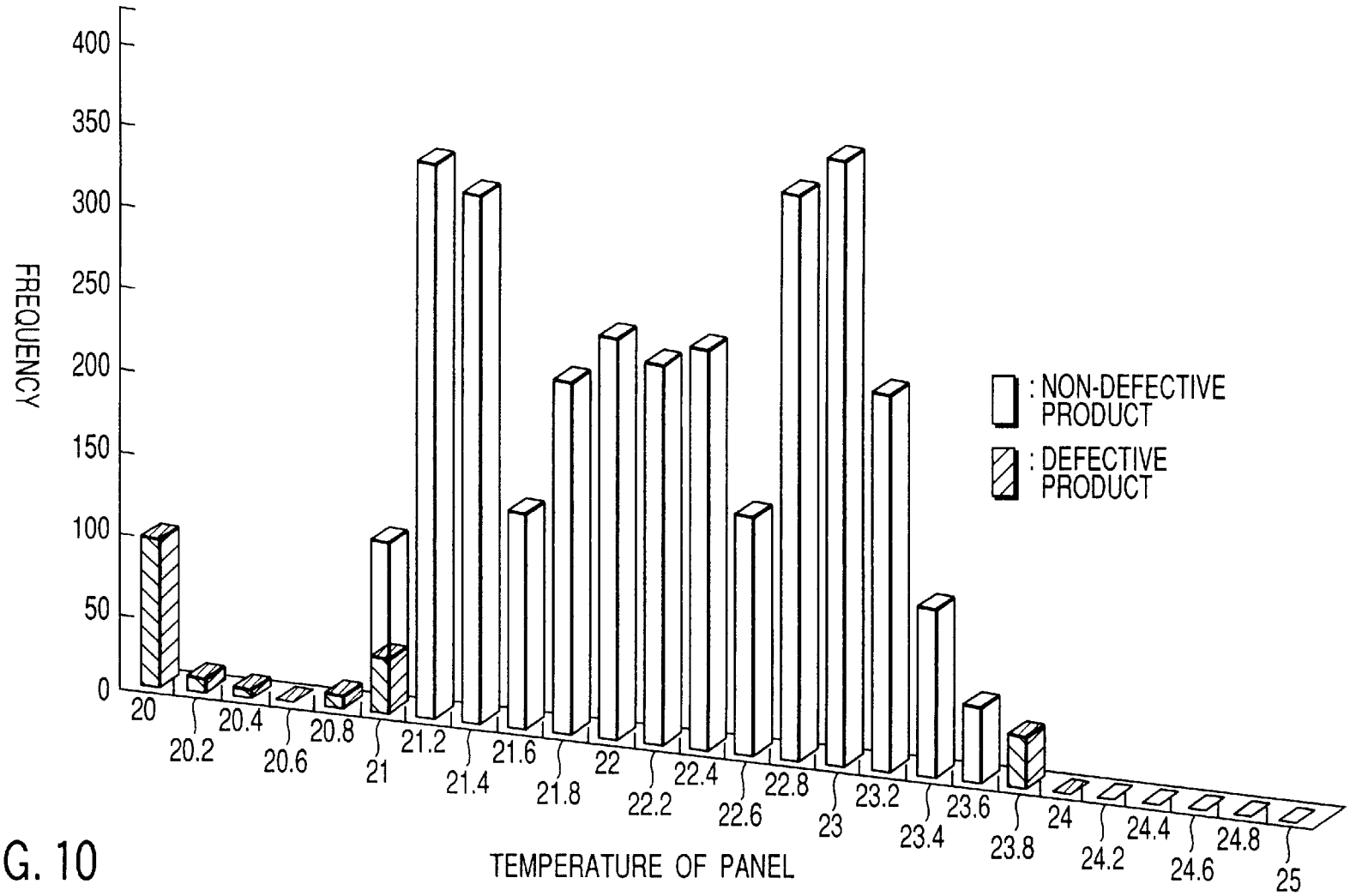
FIG. 10 is a graph illustrating another example of data items collected in the process of manufacturing a cathode ray tube, according to one embodiment of the invention.

In addition, the tendency of the temperature distributions of defective panels 11 is compared with that of the temperature distributions of non-defective panels as shown in FIG. 10. Thus, the relationship between the tendency of temperature distributions and occurrence of defective panels can be detected.

Specifically, FIG. 10 is a graph, showing the frequencies of defective and non-defective products obtained, for example, at each predetermined panel temperature that is assumed immediately before the coating of phosphor in the phosphor surface forming process. In this figure, the abscissa indicates the panel temperature, and the ordinate indicates the frequency. The hatching bar indicates the frequency of defective products, and the white bar indicates the frequency of non-defective products. As is evident from this graph, about 30% of the products are defective at a panel temperature of 21° C., and defective products also occur at a panel temperature of more than 23.6° C.

Moreover, since the input data contains characteristics of each component part measured in an on-line manner, for example, the hole size, transmittance, etc. of a mask, as well as measurement data obtained in each process, the relationship between the quality of a phosphor film and the process conditions or the characteristics of a component part can be detected by referring to the input data.

Yet further, if reference can be made to a characteristic of a semifinished product, for example, the black coating size or the measurement value of the white uniformity obtained when a resultant cathode ray tube operates, the quality of the cathode ray tube can be related to a measurement value in each process or to a characteristic of each component part, thereby enabling prompt process analysis or enabling prompt measures for dealing with defective products.

All information can be collected and managed as a data base, using a relational data base. In other words, various types of data obtained in the cathode-ray-tube manufacturing process is stored in a data base in a desired sampling cycle. In this case, concerning a predetermined product, each measurement value can be related to a corresponding work by simultaneously storing, in the data base, data obtained at each measurement point and the number of a corresponding work. From this data base, optional past information can be obtained by retrieval based on complex prerequisites, thereby enabling analysis of an optional manufacturing condition.

As described above, when performing a predetermined treatment on a component part, for example, a panel, of a cathode ray tube, in the present invention, information peculiar to each panel and measurement data on process conditions are stored such that they are coupled with each other, thereby enabling easy detection of the cause of a defect, if it occurs, by prompt process analysis for each product, each defective item, or each time zone. As a result, measures can be taken to deal with a defective product. Moreover, analysis data can be applied to feedback control for setting appropriate manufacturing conditions.

Also, collecting and managing all information as a data base by using a relational data base enables retrieval of optional past information based on complex prerequisites, and analysis of an optional.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for manufacturing a cathode ray tube, comprising:

automatically setting peculiar information to a structural element of a cathode ray tube;

performing a plurality of treatments on the structural element of the cathode ray tube in order at respective positions;

automatically measuring a condition in each treatment step;

automatically storing a measurement value obtained in the measuring step such that the value is coupled with the peculiar information;

inspecting the structural element obtained in each treatment step to determine whether or not the structural element is defective;

detecting a cause of a defect of the defective structural element by process analysis for each time zone to obtain an analysis data; and feeding back the analysis for setting an appropriate treatment condition of said treatment step;

wherein if the structural element is determined to be defective in the determination step, a defectiveness code is automatically stored coupling with the peculiar information.

2. A method according to claim 1, wherein information concerning an equipment that performs the one or more treatments is automatically stored coupling with the peculiar information.

3. A method according to claim 1, wherein a characteristic of a component part used in the treatment step is measured, and automatically stored coupling with the particular information.

4. A method according to claim 1, wherein a characteristic of a semifinished product obtained in the middle of the treatment step is measured, and automatically stored coupling with the particular information.

5. A method of manufacturing a cathode ray tube, comprising:

automatically setting peculiar information to a panel of a cathode ray tube;

performing a plurality of treatments on an inner surface of the panel of the cathode ray tube, thereby forming a phosphor film pattern on the inner surface in order at respective positions;

automatically measuring a condition in each treatment step;

automatically storing a measurement value obtained in the measuring step such that the value is coupled with the peculiar information;

inspecting the panel obtained in the treatment step to determine whether or not the panel is defective;

automatically storing a defectiveness code coupling with the peculiar information if the panel is determined to be defective;

detecting a cause of a defect of the defective panel by process analysis for each time zone to obtain an analysis data; and feeding back the analysis data for setting an appropriate treatment condition of said treatment step.

6. A method according to claim 5, wherein information concerning an equipment that performs the one or more treatments is automatically stored coupling with the particular information.

7. A method according to claim 5, wherein a characteristic of a component part used in the treatment step is measured, and automatically stored coupling with the particular information.

8. A method according to claim 5, wherein a characteristic of a semifinished product obtained in the middle of the treatment step is measured, and automatically stored coupling with the peculiar information.

9. An apparatus for manufacturing a cathode ray tube, comprising:

means for automatically setting peculiar information to a structural element of a cathode ray tube;

means for performing one or more treatments on the structural element of a cathode ray tube;

means for automatically measuring a condition of the treatment performed by the treatment means;

a controller for automatically storing a measurement value obtained by the measurement means such that the value is coupled with the peculiar information;

means for inspecting the structural element obtained from the treatment means to determine whether or not the structural element is defective; and defectiveness code input means for inputting, to the controller, a defectiveness code that indicates a defective product, and wherein the controller automatically stores the defectiveness code input by the defectiveness code input means such that the defectiveness code is coupled with to the peculiar information.

10. An apparatus according to claim 9, further comprising equipment information registration means for registering information on an equipment for performing the one or more treatments, and wherein the controller automatically stores the equipment information registered by the equipment information registration means such that the equipment information is coupled with the peculiar information.

11. An apparatus according to claim 9, further comprising component characteristic measurement means for measuring a characteristic of a component part used in the one or more treatments, and wherein the controller automatically stores a measurement value obtained by the component characteristic measurement means such that the measurement value is coupled with the peculiar information.

12. An apparatus according to claim 9, further comprising semifinished product characteristic measurement means for measuring a characteristic of a component part used in the one or more treatments, and wherein the controller automatically stores a measurement value obtained by the semifinished product characteristic measurement means such that the measurement value is coupled with the peculiar information.

13. An apparatus according to claim 9, further comprising information registration means for registering, using a relational data base, the peculiar information and the measurement value obtained by the measurement means such that the peculiar information is coupled with the measurement value.

14. A method for manufacturing a cathode ray tube, comprising:

automatically setting peculiar information to a structural element of a cathode ray tube;

performing a plurality of treatments on the structural element of the cathode ray tube in order at respective positions, wherein said plurality of treatments comprise:

coating, exposure, and development of a resist film on said structural element of said cathode ray tube;

coating of a black conductive film thereon;

coating exposure, and development of a first fluorescent screen thereon;

coating, exposure, and development of a second fluorescent screen thereon; and coating, exposure, and development of a third fluorescent screen thereon;

automatically measuring a condition in each said treatment;

automatically storing a measurement value obtained in the measuring step such that the value is coupled with the peculiar information;

inspecting the structural element obtained in each treatment step to determine whether or not the structural element is defective;

detecting a cause of a defect of the defective structural element by process analysis for each time zone to obtain an analysis data; and feeding back the analysis data for setting an appropriate treatment condition of said treatment step;

wherein if the structural element is determined to be defective in the determination step, a defectiveness code is automatically stored coupling with the peculiar information.

15. A method according to claim 14, wherein information concerning an equipment that performs the one or more treatments is automatically stored coupling with the peculiar information.

16. A method according to claim 14, wherein a characteristic of a component part used in the treatment step is measured, and automatically stored coupling with the particular information.

17. A method according to claim 14, wherein a characteristic of a semifinished product obtained in the middle of the treatment step is measured, and automatically stored coupling with the particular information.

* * * * *